United States Patent [19]

Kako

[11] Patent Number: 5,035,217

[45] Date of Patent: Jul. 30, 1991

[54] IDLING ADJUSTING METHOD

[75] Inventor: Hajime Kako, Himeji, Japan

[73] Assignee: Mitsubishi Denki K.K., Tokyo, Japan

[21] Appl. No.: 520,425

[22] Filed: May 8, 1990

[30] Foreign Application Priority Data

May 10, 1989 [JP] Japan ..... 1-117112

[51] Int. Cl.[5] ..... F02M 3/00

[52] U.S. Cl. ..... 123/339

[58] Field of Search ..... 123/339, 585, 417

[56] References Cited

U.S. PATENT DOCUMENTS

| | | | |
|---|---|---|---|
| 4,705,001 | 11/1987 | Danno et al. | 123/417 |
| 4,802,851 | 9/1989 | Washino et al. | 123/339 |
| 4,836,164 | 6/1989 | Morozumi et al. | 123/339 |
| 4,856,475 | 8/1989 | Shimomura et al. | 123/339 |
| 4,903,657 | 2/1990 | Miyazaki et al. | 123/339 |

*Primary Examiner*—Raymond A. Nelli

*Attorney, Agent, or Firm*—Sughrue, Mion, Zinn Macpeak & Seas

[57] ABSTRACT

In an idling adjusting method for the engine of a vehicle, an intake air quantity for the engine is adjusted independent of a flow rate control device so that a revolution number correcting signal or a signal related thereto is within a predetermined value, by providing a reference signal generating device which outputs a reference control signal necessary for maintaining a target engine revolution number, a correction signal generating device which generates a revolution number correction signal in the direction to reduce the deviation between an actual engine revolution number of engine and the target engine revolution number and the flow rate control device which controls the intake air quantity for the engine so as to increase or decrease by receiving the reference control signal and the revolution number correction signal, wherein the reference control signal is changed dependent on atmospheric pressure.

4 Claims, 4 Drawing Sheets

IDLING ADJUSTING METHOD

BACKGROUND OF THE INVENTION

1. Field of the Invention

The present invention relates to a method of adjusting idling revolution in the engine of a vehicle by the feed-back control of the idling revolution.

2. Discussion of Background

Description will be made as to a conventional idling adjusting method with reference to FIG. 6. In FIG. 6, a reference numeral 1 designates an engine and a numeral 2 designates an intake air pipe. A throttle valve 3 is provided in the intake air pipe 2, and a by-pass passage 9 is connected to the intake air pipe 2 so as to by-pass the throttle valve 3 between the upstream side of the throttle valve 3 and the downstream side of it. The by-pass passage 9 comprises a main by-pass passage 91 and an auxiliary by-pass passage 92 which are arranged in parallel to each other. The main by-pass passage 91 includes an intake air control valve which controls the sectional surface area of the main by-pass passage. The intake air control valve may be a solenoid valve 8 having a linear characteristic. An adjusting screw 4 is provided in the auxiliary by-pass passage 92 so as to adjust an air quantity in the auxiliary by-pass passage by adjusting the sectional surface area of the passage. The solenoid valve 8 is to be controlled and driven by an output from a driving unit 7.

A gear wheel 41 is attached to a rotary shaft in the engine 1 so that the gear wheel 41 is rotated in association with the revolution of the engine 1. The revolution of the gear wheel 41 is detected by a revolution number sensor 42. An engine revolution number $n_E$ detected by the revolution number sensor 42 through the revolution of the gear wheel 41 is output to an error amplifying device 61. The error amplifying device 61 also receives a target revolution number $n_T$ from a target revolution number generating device 5, and it generates an error $\Delta n$ of the signal $n_T$ to the signal $n_E$ so as to output the error signal to a revolution number adjusting device 62.

The target revolution number generating device 5 is to generate a predetermined target revolution number signal $n_T$ in response to various conditions such as a temperature of engine, or to generate a target non-load revolution number signal $n_T$ at the time of warming-up of the engine. The revolution number adjusting device 62 is to receive the output of the error amplifying device 61 and to output a revolution number correction signal Sc in the direction which will eliminate the error $\Delta n$ by a proportional action, an integral action or a derivative action.

A reference controlled quantity output circuit 11 outputs a reference control signal $S_T$ indicative of a reference controlled quantity (a fixed value) so that the engine revolution number $n_E$ approaches the target revolution number $n_T$. The reference control signal $S_T$ of the reference controlled quantity output circuit 11 and the output signal $S_c$ of the revolution number adjusting device 62 are added in an adder 13, and the adder 13 outputs a signal obtained by an adding operation. The output $S_T+S_c$ of the adder 13 is supplied to a limiter 12. The limiter 12 outputs a signal in which the output signal $S_T+S_c$ is limited in a predetermined range. The output of the limiter 12 is supplied to the driving unit 7, and the driving unit 7 supplies a driving signal to the solenoid valve 8 so that it is operated with a duty cycle in response to the input signal. The solenoid valve 8 is controlled by the driving signal so that a cross-sectional area of the by-pass passage 9 is increased or decreased so that an air quantity passing therethrough is increased or decreased.

The operation of the conventional idling adjusting method will be described.

When an error $\Delta n$ of revolution number takes place, the revolution number adjusting device 62 is actuated, and it generates a revolution number correction signal $S_c$. The revolution number correction signal $S_c$ has a tendency to reduce the value of the error signal $\Delta n$ generated from the error amplifying device 61, and when the error signal value $\Delta n$ becomes the smallest, the value is fixed. The output signal $S_c$ of the revolution number adjusting device 62 is added to the output signal $S_T$ of the reference controlled quantity output circuit 11 in the adder 13, and the value obtained by adding is supplied to the limiter 12. The output of the limiter 12, which is limited to a predetermined range, is supplied to the driving unit 7 so that the output signal is converted into a driving signal for the solenoid valve 8.

Adjustment of the device as shown in FIG. 6 will be described. Assuming that the adjustment is made under conditions that the throttle valve 3 is at an idling position and the engine 1 is sufficiently warmed. A correction value output circuit 20 converts the revolution number correction signal $S_c$ generated from the revolution number adjusting device 62 into a duty signal having a characteristic as shown in FIG. 7, and the duty signal is output to a meter 21 located externally. The meter 21 may be a volt meter which shows a scale corresponding to average voltage. An operator adjusts an intake air quantity with an adjusting screw 4 provided in the by-pass passage 9 so that the indication of the meter corresponds to a 50% value of duty cycle. By such adjustment, the revolution number correction signal Sc becomes 0, and an error in revolution number, which may result due to various kinds of cause including the case that an intake air quantity is reduced by the clogging of the solenoid valve 8, can be adjusted.

In the conventional idling adjusting method for the engine of a vehicle, there is found a disadvantage as follows. When adjustment of the adjusting screw is made during an idling operation at a high altitude where the density of air is thin, the degree of opening after the adjustment is greater than that at a low altitude. Accordingly, when a vehicle adjusted for idling at a high altitude moves to a low altitude it is difficult to maintain a target revolution number because the density of air at the low altitude is thicker than that of the high land. Namely, even though the solenoid valve 8, i.e., the intake air control valve is to be closed, it is impossible to control the intake air quantity because there exists the lower limit of a range of control, whereby an idling revolution number is higher than the target revolution number, hence, fuel consumption efficiency becomes poor.

SUMMARY OF THE INVENTION

It is an object of the present invention to provide an idling adjusting method for the engine of a vehicle which is capable of maintaining a target revolution number of the engine regardless of whether the vehicle is driven in a high altitude or a low altitude.

The foregoing and other objects of the present invention have been attained by providing an idling adjusting method for the engine of a vehicle wherein an intake air quantity for the engine is adjusted independent of a flow rate control means so that a revolution number correcting signal or a signal related thereto is within a predetermined value, by providing a reference signal generating means which outputs a reference control signal necessary for maintaining a target engine revolution number, a correction signal generating means which generates a revolution number correction signal in the direction to reduce the deviation between an actual engine revolution number and the target engine revolution number and the flow rate control means which controls the intake air quantity for the engine so as to increase or decrease by receiving the reference control signal and the revolution number correction signal, characterized in that said reference control signal is changed dependent on atmospheric pressure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
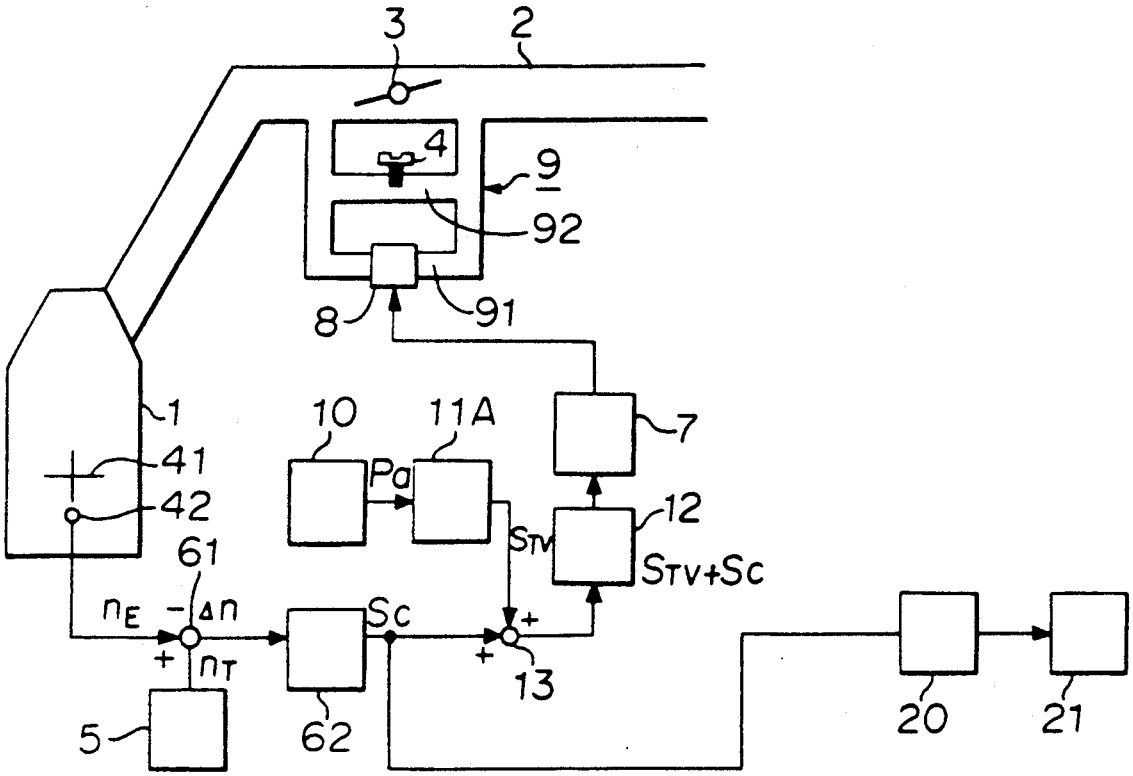
FIG. 1 is a schematic view of an engine and components for operating the engine which is used to achieve an embodiment of the idling adjusting method for the engine according to the present invention.
Figure 6:
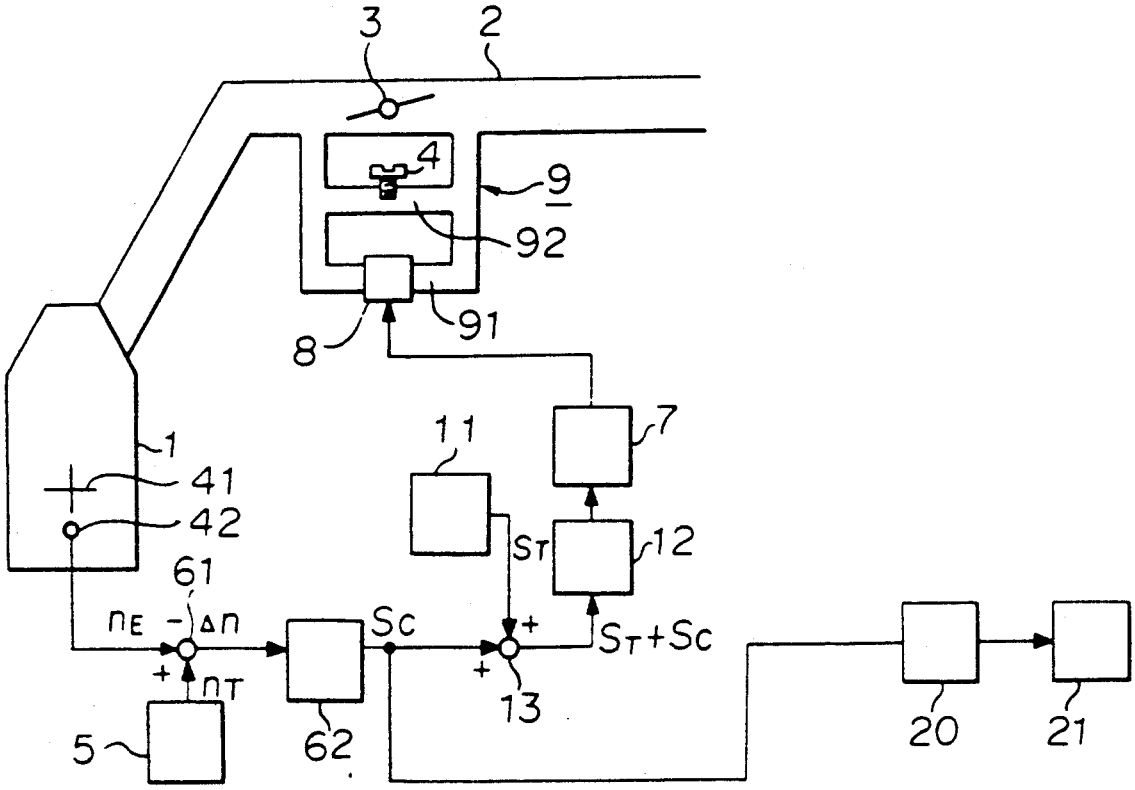
FIG. 6 is a schematic view of an engine and components for operating the engine which show a conventional idling adjusting method for the engine.
Figure 7:
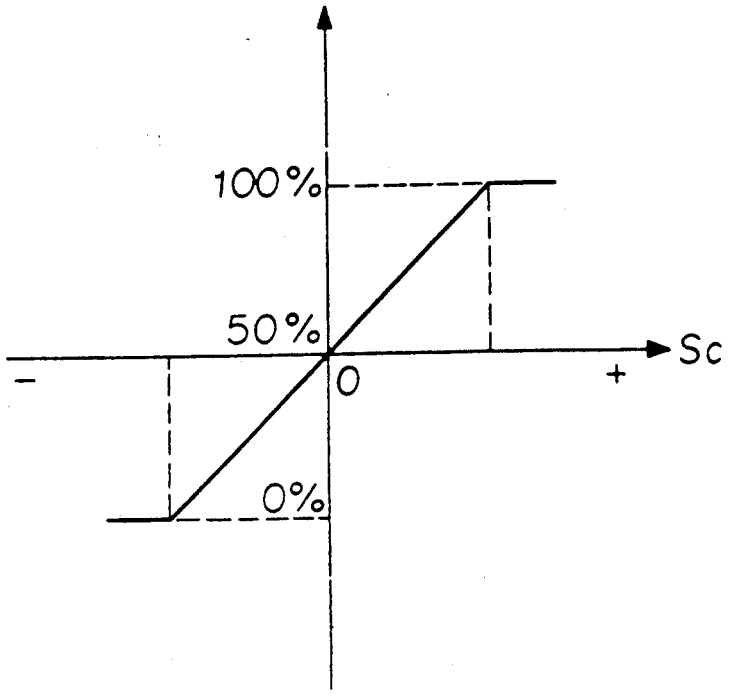
FIG. 7 is a characteristic diagram of input and output signal from a correction value output circuit.

Referring to the drawings, more particularly to FIG. 1 thereof, there is shown a schematic diagram of an embodiment of the idling adjusting method of the present invention, wherein reference numerals 1–5, 7–9, 12, 20, 21, 41, 42, 61, 62, 91 and 92 designate the same or corresponding parts as those in FIG. 6, and accordingly, description of these parts is omitted.

Figure 2:
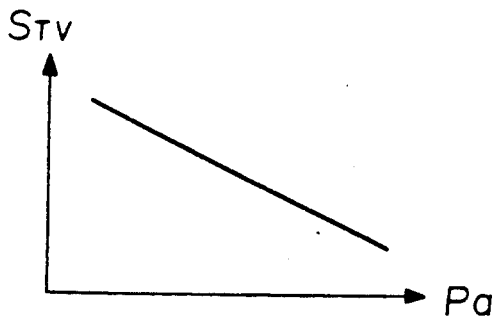
FIG. 2 is a characteristic diagram of an atmospheric pressure detection signal vs a reference control signal in the above-mentioned embodiment.

A reference numeral 10 designates an atmospheric pressure sensor such as a semiconductor pressure sensor for detecting atmospheric pressure and a numeral 11A designates a reference controlled quantity output circuit which is adapted to receive an atmospheric pressure detection signal Pa having a magnitude in proportion to an atmospheric pressure, the signal being supplied from the atmospheric pressure sensor 10, and to output a reference control signal $S_{TV}$. The magnitude of the reference control signal $S_{TV}$ becomes larger as the atmospheric pressure becomes low as shown in FIG. 2. The reference control signal $S_{TV}$ is a reference signal necessary for maintaining a target revolution number. For instance, the reference control signal $S_{TV}$ is to render an intake air quantity to be substantially constant regardless of a value of atmospheric pressure.

The adder 13 outputs to the limiter 12 a signal obtained by summing an output $S_c$ from the revolution number adjusting device 62 and an output $S_{TV}$ from the reference controlled quantity output circuit 11A.

The operation of this embodiment will be described with reference to FIG. 1.

Figure 3:
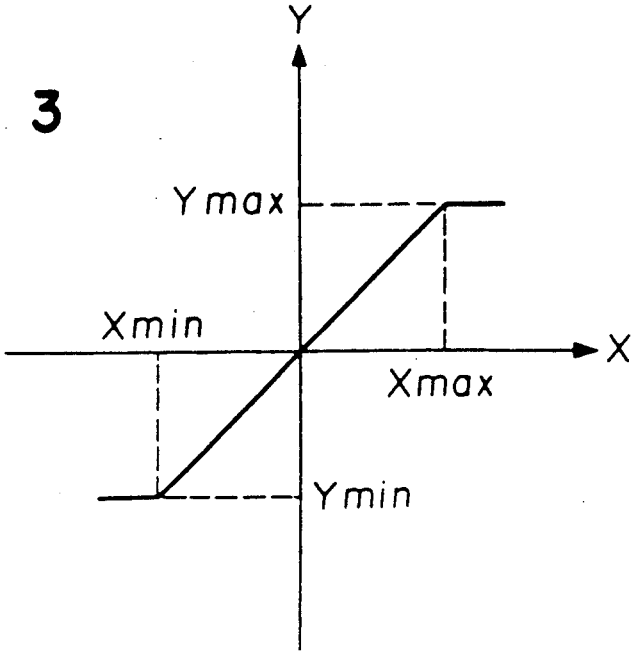
FIG. 3 is a characteristic diagram showing input and output signals from a limiter in FIG. 1.
Figure 4:
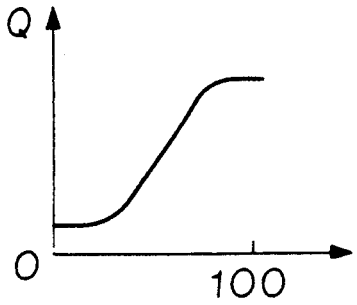
FIG. 4 is a characteristic diagram of a duty signal vs intake air controlled quantity in the above-mentioned embodiment.

The atmospheric pressure sensor 10 detects an atmospheric pressure and outputs an atmospheric pressure detection signal Pa having a magnitude in proportion to the detected atmospheric pressure. The reference controlled quantity output circuit 11A receives the signal Pa from the atmospheric pressure sensor 10 and outputs a reference control signal $S_{TV}$ which is in inverse proportion to the magnitude of the signal Pa as shown in FIG. 2. The reference control signal $S_{TV}$ assumes a value which makes the degree of opening of the solenoid valve greater as the atmospheric pressure becomes low. On the other hand, the revolution number correction signal $S_c$ from the revolution number adjusting device 62 is obtainable on the basis of an output signal from the error amplifying device 61 which receives output signals from the revolution number sensor 42 and the target revolution number generating device 5. The reference control signal $S_{TV}$ from the reference controlled quantity output circuit 11A and the revolution number correction signal $S_c$ from the revolution number adjusting device 62 are summed at the adder 13 and a signal obtained by summing is supplied to the limiter 12. The characteristic of the limiter 12 is such that as shown in FIG. 3, when an input X falls in a range of $X_{min} < X < X_{max}$, an output Y in proportion to the input X is generated, whereas when the input X is out of the range, the output Y is limited to either $Y_{min}$ or $Y_{max}$. The output of the limiter 12 is converted into a driving signal for the solenoid valve 8 as an intake air control valve by the driving unit 7. The driving signal is a duty signal. The relation of the duty cycle of the signal supplied to the solenoid valve 8 to an intake air controlled quantity Q is such as shown in FIG. 4. The intake air quantity is increased or decreased by increasing or decreasing the duty cycle.

Thus, the revolution number adjusting signal $S_{TV}+S_c$ renders the engine revolution number $n_E$ to be substantially in agreement with the target revolution number $n_T$ by adjusting the error of revolution number $\Delta n$ to be the smallest value. This is because the revolution number adjusting signal $S_{TV}+S_c$ adjusts for variation of the intake air quantity due to changes of atmospheric pressure, the variation of thermal efficiency due to temperature, the fluctuation of the structural components of the engine and the variation of loads in equipments such as lamps, a motor and so on.

The limiter 12 is to prevent the divergence of the engine revolution number so as not to deviate from a target value of intake air quantity by limiting the revolution number adjusting signal $S_{TV}+S_c$ even though it deviates in a case that the revolution number sensor 42 or the atmospheric pressure sensor 10 becomes faulty, whereby the feed-back of the revolution number becomes impossible.

The adjustment for idling of the apparatus as shown in FIG. 1 is similar to that described in the conventional method, and therefor, description is omitted. In this case, however, the degree of opening of the solenoid valve 8 should be controlled so that the intake air quantity is substantially constant regardless of the atmospheric pressure by the reference control signal $S_{TV}$ corresponding to an atmospheric pressure value, which is an output from the reference controlled quantity output circuit 11A. The adjustment of the adjusting screw 4 is made under this condition. Accordingly, the feed-back control of the solenoid valve 8 is kept within a solenoid valve driving control range event though the vehicle is driven from a high altitude to a low altitude or vice versa after the adjustment.

Figure 5:
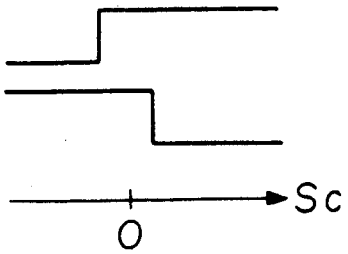
FIG. 5 is a diagram showing states of the operation of lamps for another embodiment of the idling adjusting method according to the present invention.

In the above-mentioned embodiment, a display is carried out by means of the volt meter. However, it is possible to use an adjusting method wherein two lamp display circuits are provided and adjustment in the direction of increase or adjustment in the direction of decrease is made by the indication of the lamps as shown in FIG. 5.

Various kinds of intake air control valves such as a direct current motor valve, a step motor valve or the like may be used instead of the solenoid valve.

A coded signal corresponding to the revolution number correction signal $S_c$ may be generated from the correction value output circuit 20. In a case that a computer is used to control an idling revolution number, the memory stores the correction signal $S_c$ as coded signals.

Thus, in accordance with the present invention, an intake air quantity for an engine is independently adjusted so that a revolution number correction signal or a signal related thereto assumes a previously determined value under conditions that the intake air quantity is controlled by supplying both a reference control signal corresponding to an atmospheric pressure and a revolution number correction signal which decreases an error of revolution number to a flow rate control means. Accordingly, a target revolution number can be maintained even though the vehicle is driven from a high altitude to a low altitude or vice versa after the adjustment. Therefore, fuel consumption efficiency can be improved.

Obviously, numerous modifications and variations of the present invention are possible in light of the above teachings. It is therefore to be understood that within the scope of the appended claims, the invention may be practiced otherwise than as specifically described herein.

What is claimed is:

1. An idling adjusting method for the engine of a vehicle wherein an intake air quantity for the engine is adjusted independent of a flow rate control means so that a revolution number correcting signal, or a signal related thereto, is within a predetermined value, said method comprising the steps of:

providing a reference signal generating means for outputting a reference control signal necessary for maintaining a target engine revolution number;

providing a correction signal generating means for generating a revolution number correction signal corresponding to a direction needed to reduce a deviation between an actual engine revolution number and a target engine revolution number; and providing the flow rate control means for controlling the intake air quantity for the engine so as to increase or decrease said actual engine revolution number responsive to the reference control signal and the revolution number correction signal, wherein said reference control signal is changed responsive to atmospheric pressure.

2. The idling adjusting method according to claim 1, wherein the atmospheric pressure is detected by an atmospheric pressure sensor.

3. The idling adjusting method according to claim 2, further comprising the step of supplying a pressure signal from the atmospheric pressure sensor to the reference signal generating means.

4. The idling adjusting method according to claim 1, wherein the reference signal generating means outputs a reference control signal inversely proportional to atmospheric pressure.

* * * * *